United States Patent [19]

Su

[11] Patent Number: 4,770,305

[45] Date of Patent: Sep. 13, 1988

[54] BOTTLE CAP

[76] Inventor: Yung-Fr Su, No. 28, Lane 9, Ming Yu Rd., Kang San Chen, Kaohsiung Hsien, Taiwan

[21] Appl. No.: 63,630

[22] Filed: Jun. 19, 1987

[51] Int. Cl.[4] ..... B65D 41/20

[52] U.S. Cl. ..... 215/250; 220/278

[58] Field of Search ..... 215/257, 250, 326; 220/278, 277

[56] References Cited

U.S. PATENT DOCUMENTS

| | | | |
|---|---|---|---|
| 2,361,507 | 10/1944 | Sonnenberg | 215/326 |
| 3,074,592 | 1/1963 | Stocking | 220/278 |
| 3,478,913 | 11/1969 | Kemp | 215/326 X |
| 3,931,905 | 1/1976 | Shumway et al. | 220/278 |

FOREIGN PATENT DOCUMENTS

| | | | |
|---|---|---|---|
| 555804 | 1/1957 | Italy | 220/278 |
| 810996 | 4/1969 | Canada | 220/278 |
| 476608 | 9/1969 | Switzerland | 220/278 |

*Primary Examiner*—Donald F. Norton

*Attorney, Agent, or Firm*—Varndell Legal Group

[57] ABSTRACT

A bottle cap which comprises an edge, a crown, a convex top on the crown, a cone at the interior center of the convex top, and a projection on the edge. The bottle cap is constructed in such way that after the cap is put on the mouth of the bottle, there is a clearance between the apex of the projection and an aluminum foil covering the mouth of the bottle. When the convex top is depressed with the thumb, the cone is lowered to pierce the aluminum foil, while the cap is opened by pushing the projection with the index finger. The bottle cap eliminates the need to pierce aluminum foil with a finger or other object. Accordingly, the liquids in the bottle will not be contaminated by the finger or other object before drinking. This meets economical, sanitary and easy-to-open requirements.

4 Claims, 2 Drawing Sheets

BOTTLE CAP

BACKGROUND AND SUMMARY OF THE INVENTION

This invention relates to a bottle cap suitable for various kinds of glass and plastic bottles that have screw caps or ring caps.

To prevent the contents of the bottle, such as milk, from spoiling, aluminum foil is used to close the mouth of the bottle before the cap is put on. As a result, the conventional bottle caps have the following disadvantages:

1. The cap must be removed and the aluminum foil must be pierced with a finger or other object, such as a chopstick. Alternatively, the aluminum foil must be torn along the edge before drinking. Thus, it takes time and trouble to open the bottle.

2. When the aluminum foil is pierced with a finger or other object, the contents of the bottle, such as milk, can be splash on the user or contaminated by the finger.

3. It is not easy to tear up or remove the aluminum foil from the bottle, because its edges are crimped over the mouth of the bottle. It is also possible that removing the aluminum foil may result in injury to the finger. Accordingly, the conventional structure is not safe, especially to children.

In order to eliminate these disadvantages, the inventor tried hard to make improvements and developed the present invention. The present invention has the following advantages:

1. The present invention is made of a flexible plastic and has a convex top which can be depressed and returned to its original state after the pressure is released. Normally, there is a clearance between the apex of the cap cone and the aluminum foil covering the mouth of the bottle. However, when the convex top is depressed, the cone is lowered to pierce the aluminum foil. This eliminates the need to use a finger or other object to pierce the aluminum foil.

2. By use of a projection at the edge of the cap, the cap can be removed with the index finger, while the thumb is used to depress the convex top.

3. Since the aluminum foil is pierced by the cone, there is no need to tear up or remove the aluminum foil whose edges are crimped over the mouth of the bottle by using fingers and, thus, the finger should not be injured.

4. The cone has four blades which are capable of being propped open when the convex top depressed. This permits a larger hole to be made in the aluminum foil which will not be blocked by broken pieces of foil. This permits a liquid to more easily flow out of the bottle.

5. The bottle cap of this invention can be made to fit various types of bottle mouths, such as those which employ screw caps for safe, sanitary and easy use.

DETAILED DESCRIPTION OF THE PREFERRED EMBODIMENT

Figure 3:
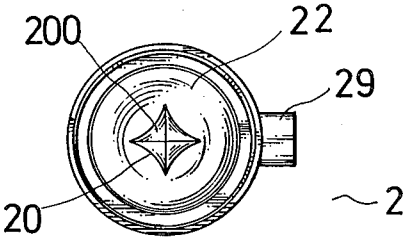
FIG. 3 is a bottom view of the bottle cap.

As shown in FIGS. 1, 2, 3 and 4, the bottle cap 2 of this invention which can be made of plastic by molding. The bottle cap has a rim 25, a crown 28, a convex top 21, and edge part 23, a projection 29 on the edge 23 and a cone 20 at the center of the concave surface 22. The crown is designed to absorb the stress produced when the convex top 21 is depressed. The projection 29 is designed to facilitate the removing of the cap itself.

Figure 2:
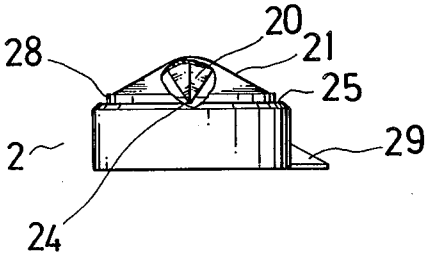
FIG. 2 is a front view with a part cut away of the crown as shown in FIG. 1.
Figure 5:
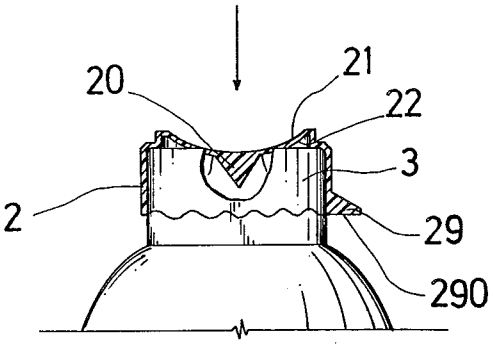
FIG. 5 is a sectional view illustrating the crown of the bottle cap being depressed.

As shown in FIGS. 2 and 3, the cone 20 has four blades 200 tapered to the apex 24 for piercing the aluminum foil and for providing a large hole in the aluminum foil 3. The edges of the aluminum foil are crimped over the mouth of the bottle, as shown in FIG. 5. The piercing of the aluminum foil and providing a hole in the aluminum foil facilitates the pouring of liquid out of the bottle.

Figure 4:
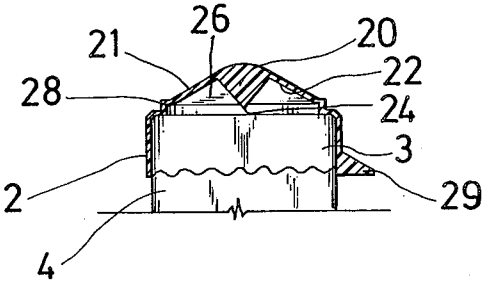
FIG. 4 is a vertical section of the bottle cap.
Figure 1:
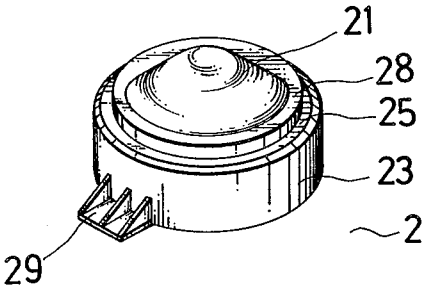
FIG. 1 is a perspective view of the new bottle cap of this invention.

As shown in FIG. 4, the mouth 4 of the bottle is closed by aluminum foil 3. The bottle cap 2 is placed on the bottle so that there is a clearance between the aluminum foil 3 and the apex 24 of the cone, together with an open area between the aluminum foil 3 and the convex top 21.

As shown in FIG. 5, when the convex top 21 is depressed with a thumb, the cone 20 is lowered to pierce the aluminum foil 3 and, at the same time, an index finger is placed on the bottom side of the projection 29 to push open the cap. This eliminates the need to pierce the aluminum foil with a finger. Thus, the present invention provides a very safe, sanitary and quick way to open a bottle for drinking.

Figure 7:
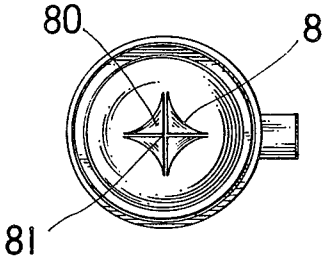
FIG. 7 is a bottom view of the another embodiment.
Figure 8:
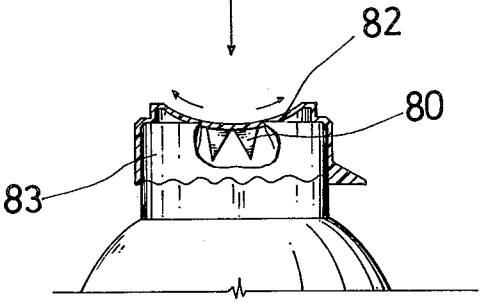
FIG. 8 is a view illustrating the crown of the another embodiment being depressed.
Figure 6:
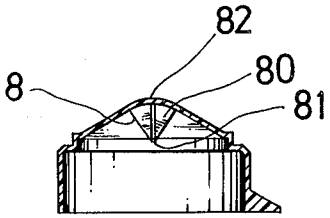
FIG. 6 is a vertical section of another embodiment of this invention.

FIGS. 6 and 7 show another embodiment of this invention. As shown therein, cone 8 consists of four printed parts 80 which are tapered to the apex 81, but when the convex top 82 is depressed, they can be propped open and become four separate sharp parts for making a larger hole in the aluminum foil.

I claim:

1. A combination of a bottle having a mouth covered with aluminum foil and a bottle cap closing the bottle, the bottle cap comprising an edge part fitting around the bottle, the edge part having a projection for removing the bottle cap from the bottle, a rim above the edge part, a crown above the rim, a convex top above the crown, and a cone having an apex and a base located within the bottle cap at a center portion of the convex top, the apex of the cone being located above the aluminum foil; the rim, the crown and the convex top permitting movement of the cone toward the aluminum foil be exerting pressure on the convex top for piercing of the aluminum foil with the apex of the cone.

2. The combination as set forth in claim 1, wherein the projection of the edge part, the convex top, and the apex of the cone are arranged to permit removal of the bottle cap by a finger pushing on the projection of the edge part while the apex of the cone pierces the aluminum foil by a thumb exerting pressure on the convex top.

3. The combination as set forth in claim 1, wherein the base of the cone includes means for inhibiting blockages of the hole formed in the aluminum foil by the apex of the cone, the means including the cone having a structure of a base having four inwardly arced lines of equal length and of a surface being formed by line segments joining every point of the base to the apex of the cone.

4. The combination as set forth in claim 1, wherein the cone has separation means for making a hole in the aluminum foil larger than that possible by a cone without the separation means, the separation means including four blades, each blade being of equal size and having an outer surface tapered to the apex, the blades being capable of separation from each other when the convex top is depressed for providing a hole in the aluminum foil.

* * * * *